US010319277B2

(12) United States Patent
Wang et al.

(10) Patent No.: US 10,319,277 B2
(45) Date of Patent: Jun. 11, 2019

(54) ORGANIC LIGHT-EMITTING DIODE (OLED) DISPLAY DEVICE

(71) Applicants: Shanghai Tianma AM-OLED Co., Ltd., Shanghai (CN); Tianma Micro-Electronics Co., Ltd., Shenzhen (CN)

(72) Inventors: Yongzhi Wang, Shanghai (CN); Zhiyong Xiong, Shanghai (CN)

(73) Assignees: Shanghai Tianma AM-OLED Co., Ltd., Shanghai (CN); Tianma Micro-Electronics Co., Ltd., Shenzhen (CN)

( * ) Notice: Subject to any disclaimer, the term of this patent is extended or adjusted under 35 U.S.C. 154(b) by 164 days.

(21) Appl. No.: 15/596,268

(22) Filed: May 16, 2017

(65) Prior Publication Data

US 2017/0249889 A1 Aug. 31, 2017

(30) Foreign Application Priority Data

Nov. 24, 2016 (CN) ..... 2016 1 1050991

(51) Int. Cl.

| | |
|---|---|
| ***G09G 5/02*** | (2006.01) |
| ***G09G 3/20*** | (2006.01) |
| ***G09G 3/3208*** | (2016.01) |

(52) U.S. Cl.

CPC ..... *G09G 3/2003* (2013.01); *G09G 3/3208* (2013.01); *G09G 2300/0452* (2013.01)

(58) Field of Classification Search

CPC ..... G09G 3/2003; G09G 3/3208; G09G 2300/0452

USPC ..... 345/694

See application file for complete search history.

(56) References Cited

U.S. PATENT DOCUMENTS

| | | | | |
|---|---|---|---|---|
| 2007/0171290 | A1* | 7/2007 | Kroger | G06T 3/4015 348/272 |
| 2010/0141812 | A1* | 6/2010 | Hirota | H04N 9/045 348/279 |
| 2015/0070374 | A1* | 3/2015 | Gong | G06T 11/001 345/589 |
| 2015/0349034 | A1* | 12/2015 | Hack | H01L 27/3218 257/40 |
| 2017/0053624 | A1* | 2/2017 | Hayashi | G09G 5/391 |
| 2017/0194389 | A1* | 7/2017 | Guo | H01L 27/3213 |

FOREIGN PATENT DOCUMENTS

CN 104795431 A 7/2015

* cited by examiner

*Primary Examiner* — Jonathan M Blancha

(74) *Attorney, Agent, or Firm* — Anova Law Group, PLLC

(57) ABSTRACT

An OLED display device is provided. The OLED display device comprises first pixel rows and second pixel rows. A first pixel row includes first and second pixel units, and a second pixel row includes third and fourth pixel units. A first, a second, a third, and a fourth pixel units have an identical hexagonal shape, and each includes a first, a second, a third, and a fourth sub-pixels, each of which has an identical pentagonal shape. The first sub-pixel in the first pixel unit, the second sub-pixel in the second pixel unit adjacent to the first pixel unit, the third sub-pixel unit in the third pixel unit adjacent to both the first pixel unit and the second pixel unit, and the fourth sub-pixel unit in the fourth pixel unit adjacent to both the first pixel unit and the second pixel unit have a same color and together form a hexagon.

20 Claims, 8 Drawing Sheets

600

ORGANIC LIGHT-EMITTING DIODE (OLED) DISPLAY DEVICE

CROSS-REFERENCES TO RELATED APPLICATIONS

This application claims the priority of Chinese Patent Application No. CN201611050991.X, filed on Nov. 24, 2016, the entire contents of which are incorporated herein by reference.

FIELD OF THE DISCLOSURE

The present disclosure generally relates to the display technology and, more particularly, relates to an organic light-emitting diode (OLED) display device.

BACKGROUND

An organic light-emitting display device adopts OLEDs to display images, in which an OLED is a self-luminous device. In the existing fabrication process of OLED pixels, pixels are deposited on an array substrate having pre-fabricated thin film transistors (TFTs) by a highly accurate alignment system and a highly precise photomask. The existing display technology is divided into a RGB (red, green, blue) three-color system and a RGBW (red, green, blue, white) four-color system.

FIG. 1 illustrates a pixel arrangement in an existing RGB three-color system. FIG. 2 illustrates a pixel arrangement in an existing RGBW four-color system. Further, the deposition masks may be divided into slit-type masks and slot-type masks. The slit-type mask is mainly used in the pixel arrangement shown in FIG. 1. The slot-type mask is mainly used in the pixel arrangement shown in FIG. 2. Other variations of the existing pixel arrangements and mask types are derived from the above-described pixel arrangements and mask types.

As the resolution of the display panel is getting higher and higher, the fabrication process of mask is getting more and more complicated. The fabrication precision or the resolution of the mask is approaching the physical limit. The current vapor deposition process often has the color mixing and misalignment issues. Thus, the fabrication complexity of the mask, and the color mixing and misalignment issues of the vapor deposition process become one of the bottlenecks, which limits the improvement of the OLED resolution and the reduction of the production cost.

Thus, reducing the fabrication complexity of the mask and preventing the color mixing in the vapor deposition process are highly desired. The disclosed OLED display device is directed to solve one or more problems set forth above and other problems.

BRIEF SUMMARY OF THE DISCLOSURE

One aspect of the present disclosure provides an OLED display device, comprising a plurality of first pixel rows and a plurality of second pixel rows alternately arranged in a first direction. A first pixel row includes a plurality of first pixel units and a plurality of second pixel units arranged alternately in a second direction, and a second pixel row includes a plurality of third pixel units and a plurality of fourth pixel units arranged alternately in the second direction. A first pixel unit, a second pixel unit, a third pixel unit, and a fourth pixel unit have an identical hexagonal shape, and each includes a first sub-pixel, a second sub-pixel, a third sub-pixel, and a fourth sub-pixel. The first sub-pixel, the second sub-pixel, the third sub-pixel, and the fourth sub-pixel have an identical pentagonal shape, and the first pixel unit, the second pixel unit, the third pixel unit, and the fourth pixel unit each includes at least three colors. The first sub-pixel in the first pixel unit, the second sub-pixel in the second pixel unit adjacent to the first pixel unit, the third sub-pixel unit in the third pixel unit adjacent to both the first pixel unit and the second pixel unit, and the fourth sub-pixel unit in the fourth pixel unit adjacent to both the first pixel unit and the second pixel unit have a same color and together form a hexagon.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the disclosure, which are illustrated in the accompanying drawings. Wherever possible, the same reference numbers will be used throughout the drawings to refer to the same or like parts. It should be understood that the exemplary embodiments described herein are only intended to illustrate and explain the present disclosure and not to limit the present disclosure. In addition, it should also be noted that, for ease of description, only part, but not all, of the structures associated with the present disclosure are shown in the accompanying drawings.

Figure 3:
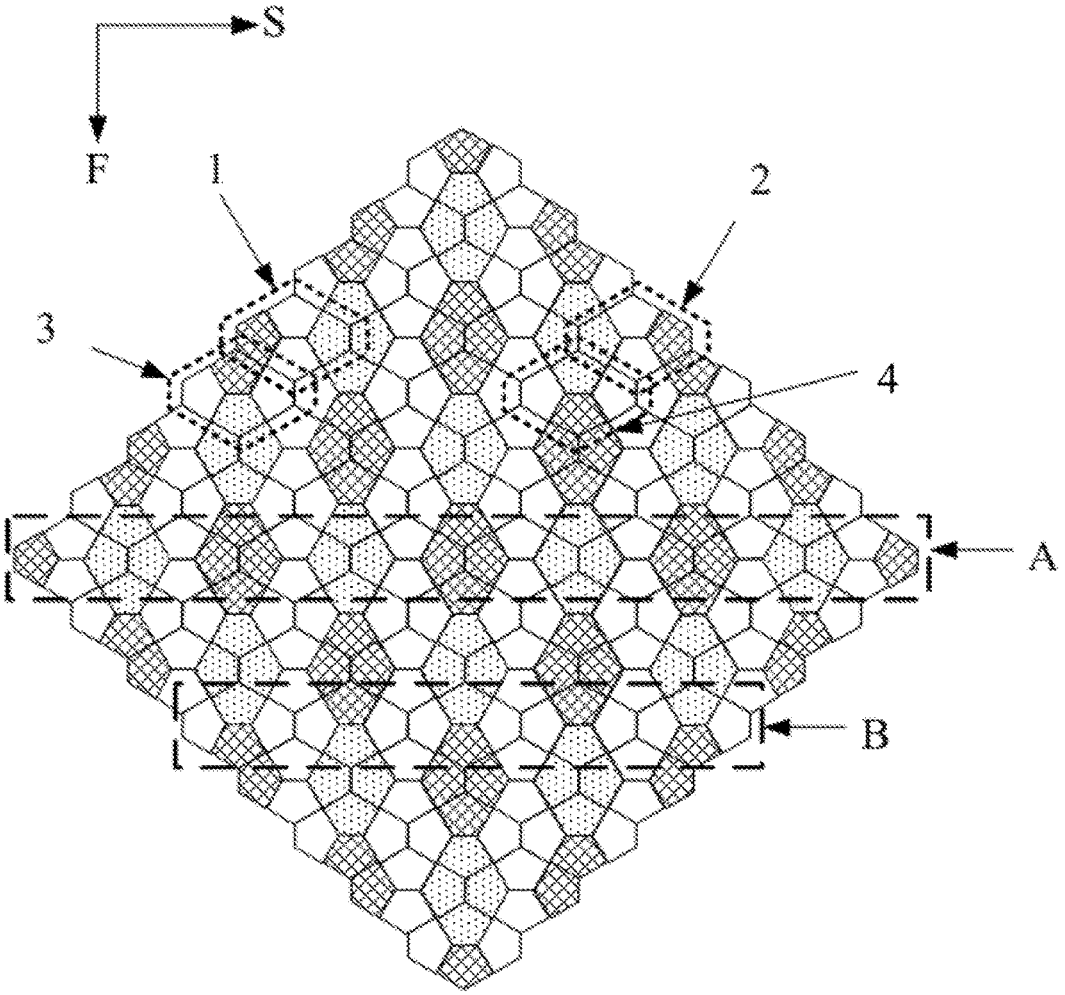
FIG. 3 illustrates a schematic view of an exemplary RGB pixel arrangement in an exemplary OLED display device according to the disclosed embodiments.

The present disclosure provides an OLED display device. FIG. 3 illustrates a schematic view of an exemplary RGB pixel arrangement in an exemplary OLED display device according to the present disclosure. As shown in FIG. 3, the OLED display device may include a first pixel row A and a second pixel row B arranged alternately in a first direction F. The first pixel row A may include a first pixel unit 1 and a second pixel unit 2 arranged alternately in a second direction S. The first pixel unit 1 and the second pixel unit 2 may be centrally symmetric with respect to the center point of a line between the center points of the first pixel unit 1 and the second pixel unit 2.

The second pixel row B may include a third pixel unit 3 and a fourth pixel unit 4 arranged alternately in the second direction S. The third pixel unit 3 and the fourth pixel unit 4 may be centrally symmetric with respect to the center point of a line between the center points of the third pixel unit 3 and the fourth pixel unit 4. The center point of the third pixel unit 3 and the fourth pixel unit 4 may be located on the perpendicular bisector of the line between the center points of the adjacent first pixel unit 1 and the adjacent second pixel unit 2. The center point of the fourth pixel unit 4 may be located on the perpendicular bisector of the line between the center points of the adjacent first pixel unit 1 and the adjacent second pixel unit 2.

The first pixel unit 1, the second pixel unit 2, the third pixel unit 3, and the fourth pixel unit 4 each may have a same hexagonal shape, and each may include a first sub-pixel, a second sub-pixel, a third sub-pixel, and a fourth sub-pixel. The first direction F and the second direction S are for illustrative purposes and are not intended to limit the scope of the present disclosure.

Figure 4:
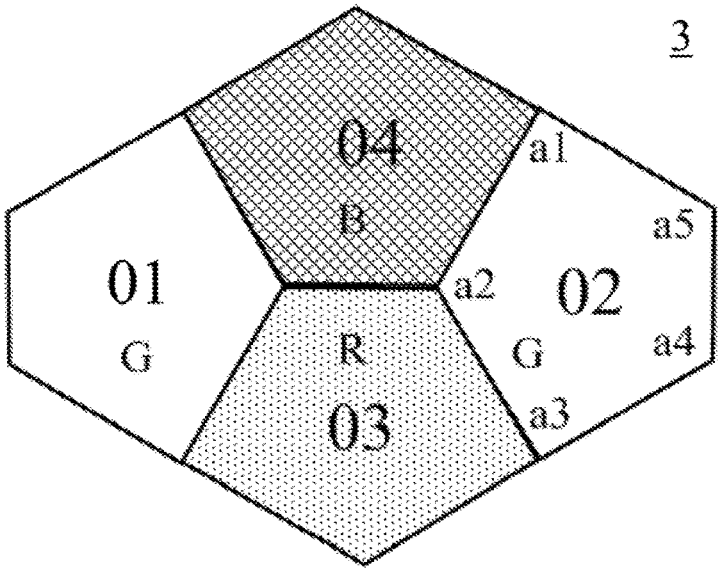
FIG. 4 illustrates an enlarged view of an exemplary third pixel unit in an exemplary OLED display device in FIG. 3 according to the disclosed embodiments.

FIG. 4 illustrates an enlarged view of an exemplary third pixel unit in an exemplary OLED display device in FIG. 3 according to the present disclosure. Other pixel units in FIG. 3 may have the same shape and size as the third pixel unit 3. As shown in FIG. 4, the third pixel unit 3 may include a first sub-pixel 01, ta second sub-pixel 02, a third sub-pixel 03, and a fourth sub-pixel 04, each of which may have a same pentagonal shape. The third pixel unit 3 include at least three colors. The first sub-pixel 01 and the second sub-pixel 02 may be centrally symmetric with respect to the center point of the pixel unit 3. The third sub-pixel 03 and the fourth sub-pixel 04 may be centrally symmetric with respect to the center point of the pixel unit 3. The pentagon may have a first inner angle a1, a second inner angle a2, a third inner angle a3, a fourth inner angle a4, and a fifth inner angle a5, sequentially. The first inner angle a1 and the third inner angle a3 may be right angles. Two sides of the first inner angle a1 may have an equal length, and two sides of the third inner angle a3 may have an equal length.

Referring to FIG. 3 and FIG. 4, the first sub-pixel 01 in the first pixel unit 1 may have a same color as the second sub-pixel 02 in the second pixel unit 2 adjacent to the first pixel unit 1, the third sub-pixel 03 in the third pixel unit 3 adjacent to both the first pixel unit 1 and the second pixel unit 2, and the fourth sub-pixel 04 in the fourth pixel unit 4 adjacent to both the first pixel unit 1 and the second pixel unit 2, in which the four sub-pixels of the same color may together form a hexagon.

In the disclosed embodiments, the first pixel unit 1 and the second pixel unit 2 may be centrally symmetric with respect to the center point of the line between the center point of the first pixel unit 1 and the center point of the second pixel unit 2. The third pixel unit 3 and the fourth pixel unit 4 may be centrally symmetric with respect to the center point of the line between the center point of the third pixel unit 3 and the center point of the fourth pixel unit 4. Meanwhile, the center point of the third pixel unit 3 may be located on the perpendicular bisector of the line between the center points of the adjacent first pixel unit 1 and the adjacent second pixel unit 2. The center point of the fourth pixel unit 4 may be located on the perpendicular bisector of the line between the center points of the adjacent first pixel unit 1 and the adjacent second pixel unit 2.

Thus, regardless of the color of the first sub-pixel 01 in the first pixel unit 1, as long as the first sub-pixel 01 in the first pixel unit 1 has the same color as the third sub-pixel 03 in the third pixel unit 3 adjacent to the first pixel unit 1, the first sub-pixel 01 in the first pixel unit 1 may have the same color as the second sub-pixel 02 in the second pixel unit 2 adjacent to the first pixel unit 1, the third sub-pixel 03 in the third pixel unit 3 adjacent to both the first pixel unit 1 and the second pixel unit 2, and the fourth sub-pixel 04 in the fourth pixel unit 4 adjacent to both the first pixel unit 1 and the second pixel unit 2, in which the four sub-pixels of the same color may form a hexagon.

Figure 5:
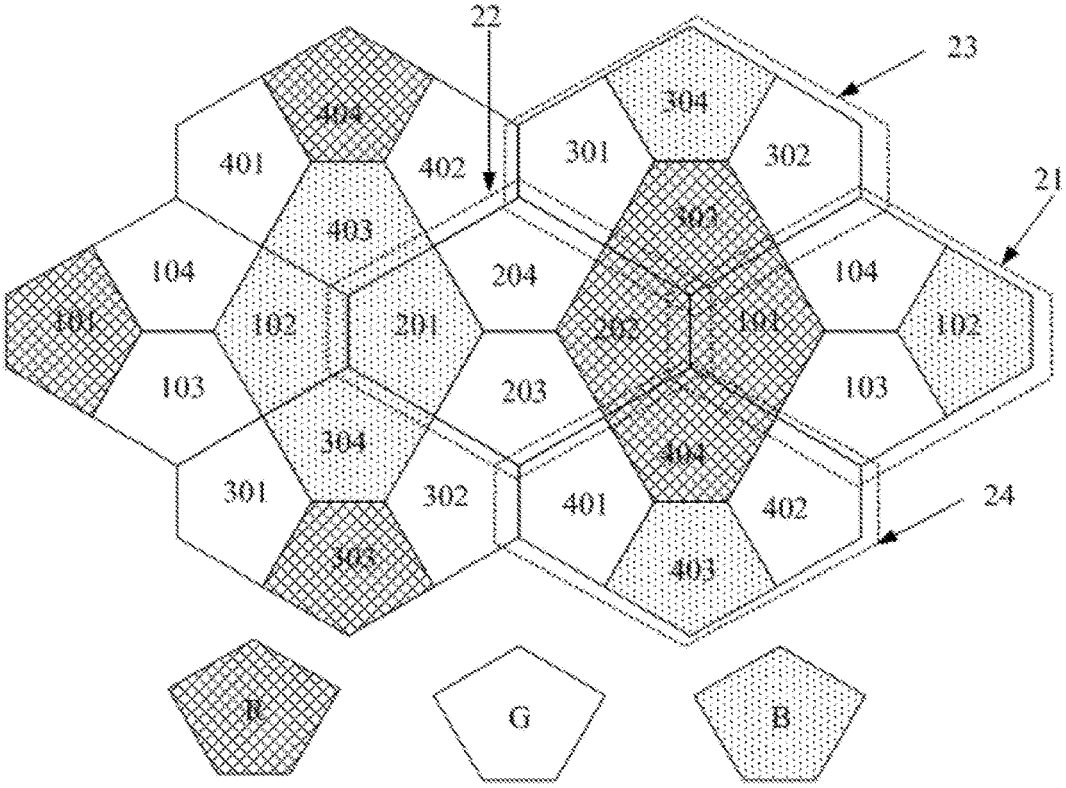
FIG. 5 illustrates a partial view of an exemplary RGB pixel arrangement in an exemplary OLED display device in FIG. 3 according to the disclosed embodiments.

FIG. 5 illustrates a partial view of an exemplary RGB pixel arrangement in an exemplary OLED display device in FIG. 3 according to the present disclosure. For the convenience of illustration, in the disclosed embodiments, the first sub-pixel 01 in the first pixel unit 21 is denoted as 101, the second sub-pixel 02 in the first pixel unit 21 is denoted as 102, the third sub-pixel 03 in the first pixel unit 21 is denoted as 103, and the fourth sub-pixel 04 in the first pixel unit 21 is denoted as 104. Similarly, the first sub-pixel 01 in the second pixel unit 22 is denoted as 201, the third sub-pixel 03 in the third pixel unit 23 is denoted as 303, and the fourth sub-pixel unit 04 in the fourth pixel unit 24 is denoted as 404.

As shown in FIG. 5, the first sub-pixel 101 in the first pixel unit 21 may have the same color as the second sub-pixel 202 in the second pixel unit 22 adjacent to the first pixel unit 21, the third sub-pixel 303 in the third pixel unit 23 adjacent to both the first pixel unit 21 and the second pixel unit 22, and the fourth sub-pixel 404 in the fourth pixel unit 24, in which the four sub-pixels of the same color may form a hexagon.

Further, as shown in FIG. 5, the second sub-pixel 102 in the first pixel unit 21 may have the same color as the first sub-pixel 201 in the second pixel unit 22 adjacent to the first pixel unit 21, the fourth sub-pixel 304 in the third pixel unit 23 adjacent to both the first pixel unit 21 and the second pixel unit 22, and the third sub-pixel 403 in the fourth pixel unit 24, in which the four sub-pixels of the same color may form a hexagon.

Similarly, the third sub-pixel 103 in the first pixel unit 21 may also have the same color as the corresponding sub-pixels in other pixel units, in which the four sub-pixels of the same color may together form a hexagon. The fourth sub-pixel 104 in the first pixel unit 21 may also have the same color as the corresponding sub-pixels in other pixel units, in which the four sub-pixels of the same color may together form a hexagon.

In the disclosed embodiments, the OLED display device may include the first pixel unit, the second pixel unit, the third pixel unit, and the fourth pixel unit arranged repetitively. Each pixel unit may include four sub-pixels. The four sub-pixels may have the same pentagonal shape and size, and together may form the hexagon. By arranging the four pixel units, the sub-pixels disposed in different pixel units while having the same color may form the hexagon.

Thus, when fabricating the mask, the hexagon formed by the sub-pixels having the same color may be formed as one opening of the mask (i.e., the mask may have a plurality of hexagonal openings), thereby increasing the size of the mask opening (i.e., hexagonal opening) and the gap between the openings. Thus, the complexity of the mask fabrication process may be reduced. In the vapor deposition process of the pixel colors, the increased feature size of the mask may reduce the difficulty of mask alignment, and may suppress the color mixing. Because the complexity of the mask fabrication process is reduced and the color mixing is suppressed during the vapor deposition, the display panel resolution may be further improved.

Referring to FIG. 4, four pentagons may form a hexagon, in which the first inner angle a1 and the third inner angle a3 of the pentagon each may have to be right angles, both sides of the first inner angle a1 may have an equal length, both sides of the third inner angle a3 may have an equal length, and the four pentagons may be arranged centrally and symmetrically to form a hexagon. Geometric calculation shows that the second inner angle a2 may be an obtuse angle to form the pentagon. Further, the sum of the second inner angle a2, the fourth inner angle a4, and the fifth inner angle a5 may be equal to 360 degrees. Thus, the sum of the fourth inner angle a4 and the fifth inner angle a5 may be greater than 180 degrees.

As long as the sum of the fourth inner angle a4 and the fifth inner angle a5 is greater than 180 degrees, the fourth inner angle a4 and the fifth inner angle a5 may have any appropriate sizes. The sizes of the fourth inner angle a4 and the fifth inner angle a5 are not limited by the present disclosure.

Figure 6:
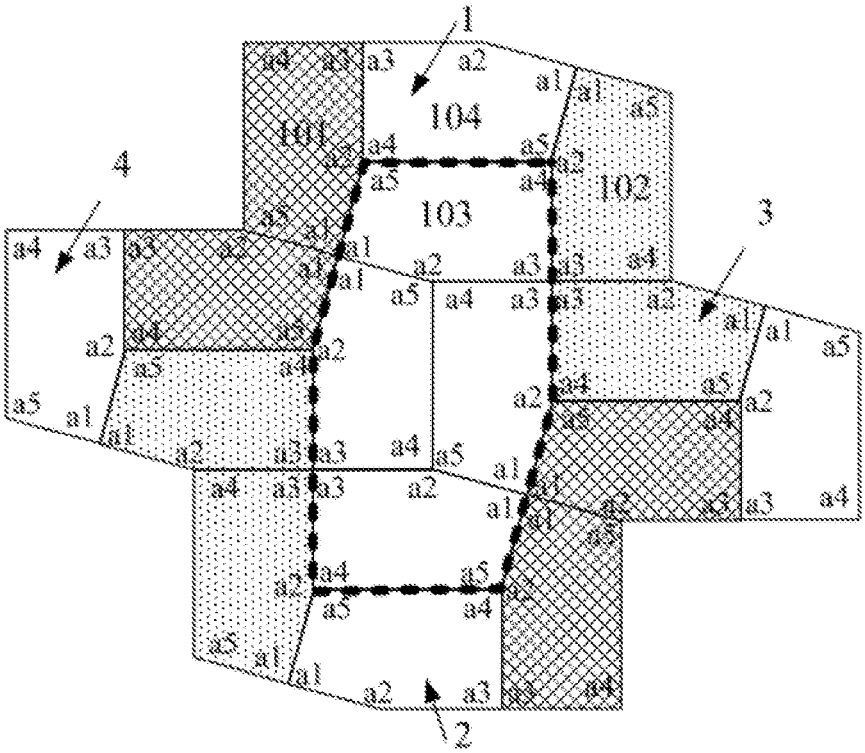
FIG. 6 illustrates a schematic view of another exemplary RGB pixel arrangement in an exemplary OLED display device according to the disclosed embodiments.
Figure 7:
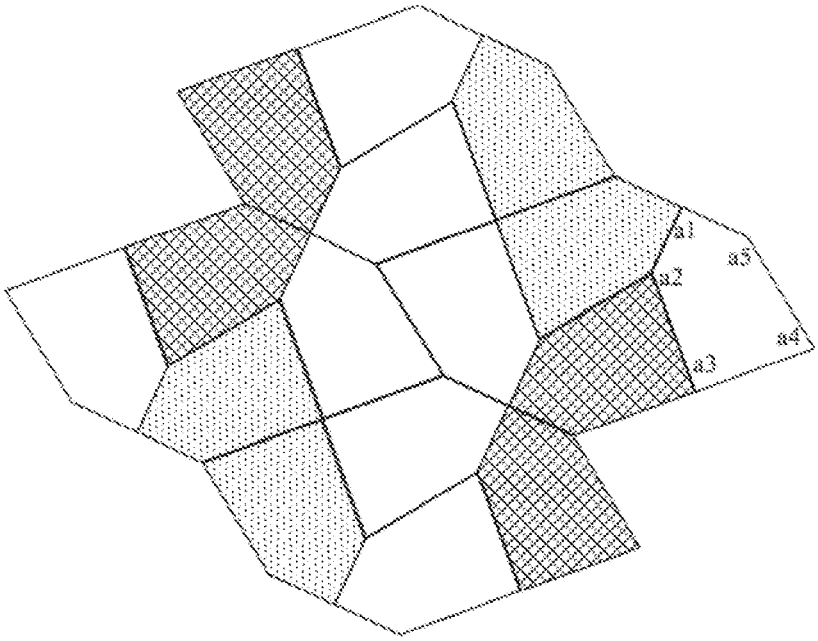
FIG. 7 illustrates a schematic view of another exemplary RGB pixel arrangement in an exemplary OLED display device according to the disclosed embodiments.

For example, the fourth inner angle a4 may be an acute angle, a right angle, or an obtuse angle. In one embodiment, as shown in FIG. 4, the fourth inner angle a4 may be an obtuse angle. In another embodiment, as shown in FIG. 6, the fourth inner angle a4 may be a right angle. In another embodiment, as shown in FIG. 7, the fourth inner angle a4 may be an acute angle. As shown in FIG. 6, the six inner angles of the hexagon formed by the four sub-pixels having the same color may include two fifth inner angles a5, two fourth inner angles a4, and two second inner angles a2. In the actual vapor deposition process, the hexagon formed by the four sub-pixels having the same color, which are denoted by the dashed line shown in FIG. 6, will be used to fabricate a common mask for the vapor deposition process.

Further, a shadow effect may exist in the vapor deposition of the organic light-emitting material. That is, the vapor deposition diffusion effect may occur at the edges of the mask. The organic light-emitting material may be vapor deposited into the area that is not an opening of the mask. Thus, the uniformity or consistency of the vapor deposition may be affected, and the design of the pixel aperture ratio may also be affected.

Further, when the inner angles of the sub-pixels become smaller, the shadow effect during the vapor deposition of the organic light-emitting materials may become even worse. In one embodiment, the fourth inner angle a4 may be configured to be a right angle or an obtuse angle.

Figure 1:
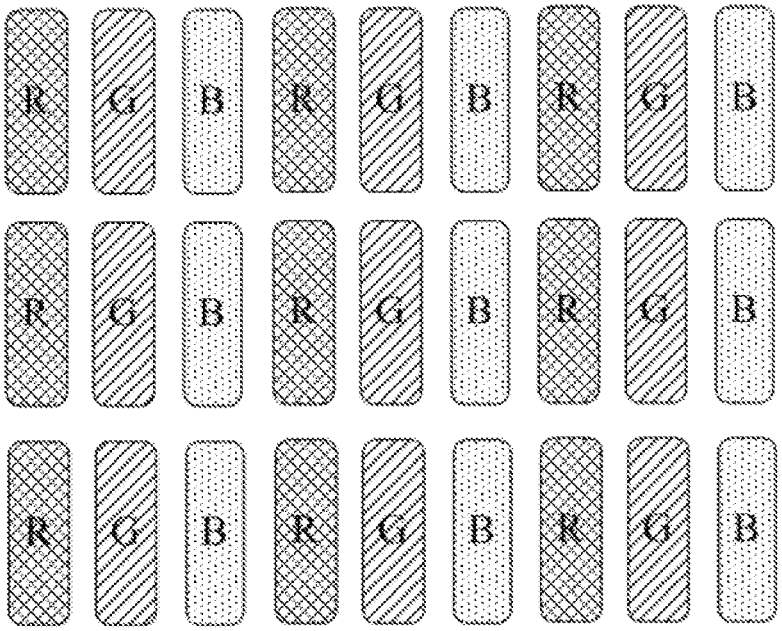
FIG. 1 (Prior Art)
FIG. 1 illustrates a schematic view of an existing RGB pixel arrangement.
Figure 2:
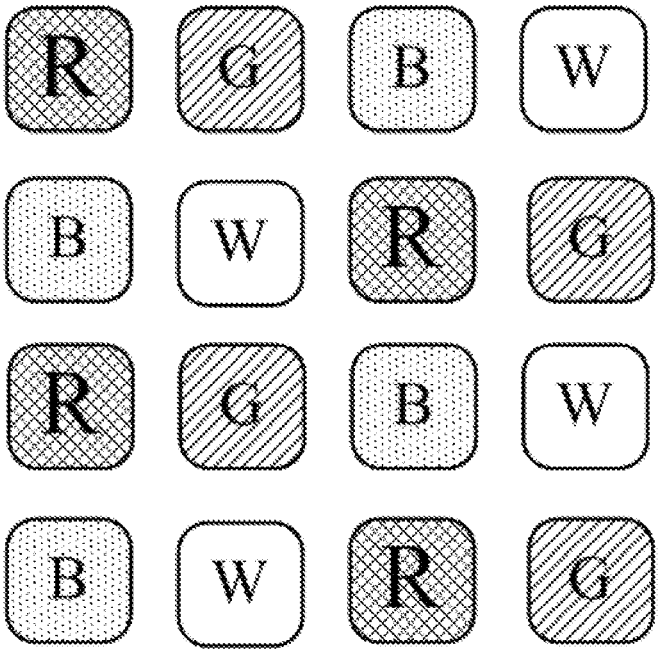
FIG. 2 (Prior Art)
FIG. 2 illustrates a schematic view of an existing RGBW pixel arrangement.

In the existing technology, either the slit-type mask as shown in FIG. 1 or the slot-type mask as shown in FIG. 2 are often used. In both cases, all the inner angles of the sub-pixels in the mask are 90 degrees (i.e. right angles). In the disclosed embodiments, when the fourth inner angle a4 is a right angle, all other inner angles are obtuse angles. Thus, the shadow effect in the vapor deposition of the organic light-emitting materials may be suppressed. When the fourth inner angle a4 is an obtuse angle and all other inner angles are also obtuse angles, the shadow effect may be substantially suppressed.

In the disclosed embodiments, the sub-pixels having the same color together may together form the hexagon as one opening in the mask, such that both the size of the openings and the gap between the openings may be increased, and the mask fabrication process complexity may be reduced. At the same time, the inner angles of the openings of the vapor deposition mask may be configured to be greater than or equal to 90 degrees, such that the vapor deposition shadow effect on the aperture ratio design and the uniformity of the deposition in the light-emitting area may be reduced.

Further, the relationship between the two sides of the first inner angle a1 and the relationship between the two sides of the third inner angle a3 are not limited by the present disclosure, as long as the pentagonal shape is formed. When the two sides of the first inner angle a1 are not equal, the two sides of the third inner angle a3 are not equal, and the fourth inner angle a4 varies, hexagons of different shapes may be formed. For the convenience of vapor deposition mask fabrication, in one embodiment, the two sides of the first inner angle a1 are equal and the two sides of the third inner angle a3 are equal. As shown in FIG. 4 and FIG. 5, the hexagons formed in this way may have four sides with an equal length, and the other two opposite sides with a different equal length.

Figure 8:
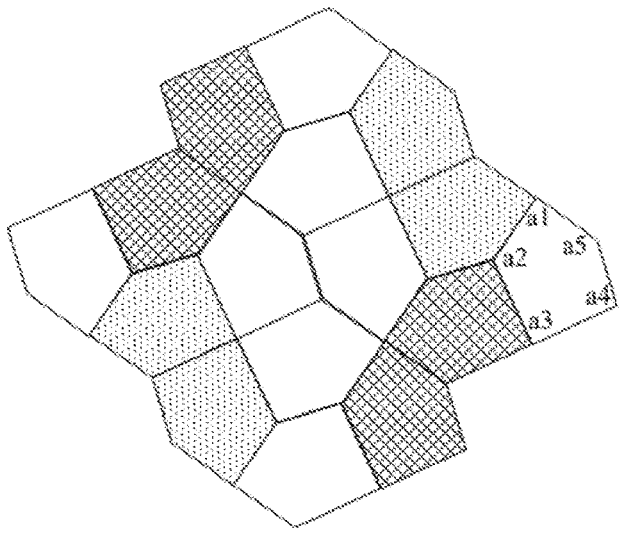
FIG. 8 illustrates a schematic view of another exemplary RGB pixel arrangement in an exemplary OLED display device according to the disclosed embodiments.

In another embodiment, as shown in FIG. 6, FIG. 7, and FIG. 8, the hexagons may have any two opposite sides with equal lengths. That is, the hexagons may have three pairs of opposite sides with equal lengths. Compared to the more irregular hexagons shown in FIG. 6, FIG. 7, and FIG. 8, the hexagons shown in FIG. 4 and FIG. 5 may be easier to be fabricated to in the practical production process.

Further, the colors of the sub-pixels in the pixel unit are not limited by the present disclosure, as long as each pixel unit includes at least red, green and blue colors for realizing the display function. In one embodiment, as shown in FIG. 5, each pixel unit may include red, green and blue colors. Because each pixel unit includes four sub-pixels, two sub-pixels among the four sub-pixels may have a same color. In particular, neither the two sub-pixels having the same color nor the color of the two sub-pixels having the same color are limited by the present disclosure.

Because the first pixel unit, the second pixel unit, the third pixel unit, and the fourth pixel unit have exactly the same structure, and the first sub-pixel in the first pixel unit has the same color as the adjacent sub-pixels in the other pixel units forming the hexagon, as long as the colors of the four sub-pixels in the first pixel unit are determined, the colors of the sub-pixels in the second pixel unit, the third pixel unit, and the fourth pixel unit may also be uniquely determined. Thus, in the following embodiments of the present disclosure, only the colors of the sub-pixels in the first pixel unit are illustrated, assuming that the colors of the sub-pixels in the other pixel units are determined by the colors of the sub-pixels in the first pixel unit.

In one embodiment, in the first pixel unit, the first sub-pixel and the second sub-pixel may have the same color, and the third sub-pixel and the fourth sub-pixel may have different colors. A corresponding structure is shown in FIG. 3. Because the reference labels 1, 2, are only used to differentiate different pixel units for the convenience of illustration, and do not have specific meanings, another exemplary sub-pixel color arrangement may be obtained by switching the reference labels of the first pixel unit 1 and the third pixel unit 3 and, meanwhile, switching the reference labels of the second pixel unit 2 and the fourth pixel unit 4. Thus, those skilled in the art may easily derive from FIG. 3 the sub-pixel color arrangement in the first pixel unit, in which the first sub-pixel and the second sub-pixel have the same color, and the third sub-pixel and the fourth sub-pixel have different colors. The detailed descriptions are not repeated here.

In another embodiment, in the first pixel unit, the first sub-pixel and the second sub-pixel may have different colors, and the third sub-pixel and the fourth sub-pixel may have the same color. A corresponding structure is shown in FIG. 5. As shown in FIG. 5, the third sub-pixel 103 and the fourth sub-pixel 104 in the first pixel unit 21 may have the same green color G, the second sub-pixel 102 has the blue color B, and the first sub-pixel 101 has the red color R. The colors of the corresponding sub-pixels in the second pixel unit 22, the third pixel unit 23, and the fourth pixel unit 24 may be determined accordingly. The detailed descriptions are not repeated here.

Figure 9:
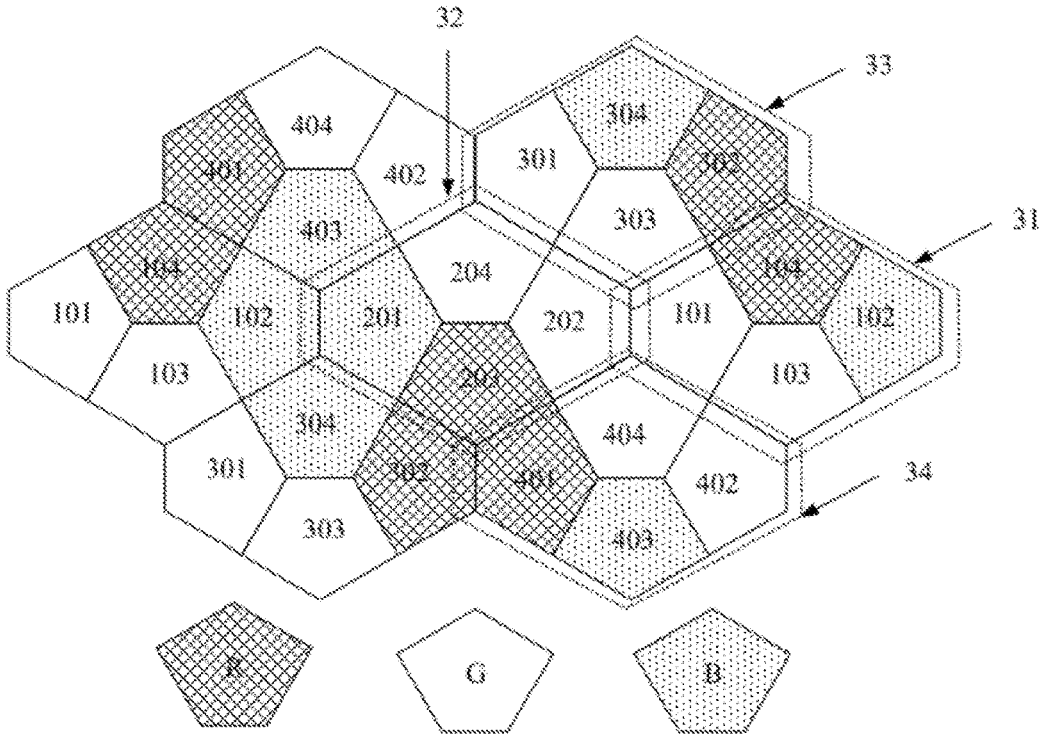
FIG. 9 illustrates a partial view of another exemplary RGB pixel arrangement in an exemplary OLED display device in FIG. 3 according to the disclosed embodiments.

In another embodiment, in the first pixel unit, the first sub-pixel and the third sub-pixel may be configured to have the same color, and the third sub-pixel and the fourth sub-pixel may be configured to have different colors. A corresponding structure is shown in FIG. 9. As shown in FIG. 9, the first sub-pixel 101 and the third sub-pixel 103 in the first pixel unit 31 may have the same green color G, the second sub-pixel 102 has the blue color B, and the fourth sub-pixel 104 has red color R. The colors of the corresponding sub-pixels in the second pixel unit 32, the third pixel unit 33, and the fourth pixel unit 34 may be determined accordingly. The detailed descriptions are not repeated here.

In certain embodiments, the colors of the sub-pixels in the first pixel unit may be arranged in such way that the first sub-pixel and the second sub-pixel have a same color, and the third sub-pixel and the fourth sub-pixel have different colors. When the first sub-pixel and the second sub-pixel in the first pixel unit have green color, the third sub-pixel (or the fourth sub-pixel) may have red color, and the fourth sub-pixel (or the third sub-pixel) may have blue color. When the first sub-pixel and the second sub-pixel in the first pixel unit have red color, the third sub-pixel (or the fourth sub-pixel) may have green color, and the fourth sub-pixel (or the third sub-pixel) may have blue color. When the first sub-pixel and the second sub-pixel in the first pixel unit have blue color, the third sub-pixel (or the fourth sub-pixel) may have red color, and the fourth sub-pixel (or the third sub-pixel) may have green color.

In certain other embodiments, the colors of the sub-pixels in the first pixel unit may be arranged in such way that the first sub-pixel and the third sub-pixel have a same color, and the second sub-pixel and the fourth sub-pixel have different colors. When the first sub-pixel and the third sub-pixel in the first pixel unit have green color, the second sub-pixel (or the fourth sub-pixel) may have red color, and the fourth sub-pixel (or the second sub-pixel) may have blue color. When the first sub-pixel and the third sub-pixel in the first pixel unit have red color, the second sub-pixel (or the fourth sub-pixel) may have green color, and the fourth sub-pixel (or the second sub-pixel) may have blue color. When the first sub-pixel and the third sub-pixel in the first pixel unit have blue color, the second sub-pixel (or the fourth sub-pixel) may have red color, and the fourth sub-pixel (or the second sub-pixel) may have green color.

The green sub-pixels often have higher brightness than the red and blue sub-pixels. When the two sub-pixels of the same color in the first pixel unit are configured to have the green color, the aperture ratio of the green sub-pixels in the overall pixel arrangement may be twice as large as the aperture ratio of the red or blue sub-pixels. Compared to the existing technology shown in FIG. 1, which has a uniform pixel arrangement of the red, green and blue colors, the disclosed pixel arrangement may be able to provide higher brightness. Thus, the disclosed OLED display device may have lower power consumption than the existing OLED display devices. Thus, in one embodiment, the two sub-pixels of the same color in the first pixel unit may be configured to have the green color.

Further, the blue color sub-pixels often have longer life span than the red color and the green color sub-pixels. To extend the life span of the OLED display panels is concerned, the two sub-pixels of the same color in the first pixel unit may be configured to have the blue color. The colors of the four sub-pixels in the first pixel unit are not limited by the present disclosure, and may be determined according to the actual design requirements.

In certain embodiments, as shown in FIG. 3, and FIGS. 5-9, in the OLED display devices, a plurality of pixel units may be arranged in a repetitive pattern, and one of the sub-pixels in the pixel unit may form a hexagon having a same color with the sub-pixels in the adjacent pixel units. That is, the sub-pixels forming the hexagon may have the same color. Thus, the sub-pixels of the hexagon having the same color may be treated together as one entire opening in the fabrication of the mask for the vapor deposition process. Compared to the existing technology in which each sub-pixel is treated as one opening in the mask fabrication, in the disclosed mask OLED display devices, the vapor deposition mask may have a larger feature size.

For example, as shown in FIG. 3, the gap between the same color openings of the mask may be increased, such that the complexity of the mask fabrication may be reduced. During the vapor deposition of the same color sub-pixels, the feature size of the mask may be increased, such that the difficulty of the mask alignment may be reduced, and the color mixing in the vapor deposition may be suppressed. Because the complexity of the mask fabrication is reduced, and the color mixing in the vapor deposition is suppressed, the resolution of the display panels may be further improved.

Further, the hexagons in the mask may be configured to only have obtuse inner angles. As s result, the vapor deposition shadow effect may have less impact on the uniformity of the sub-pixel color in the vapor deposition process, the color mixing between adjacent sub-pixels having different colors may be suppressed, and the risk of the color mixing may be reduced.

Figure 10:
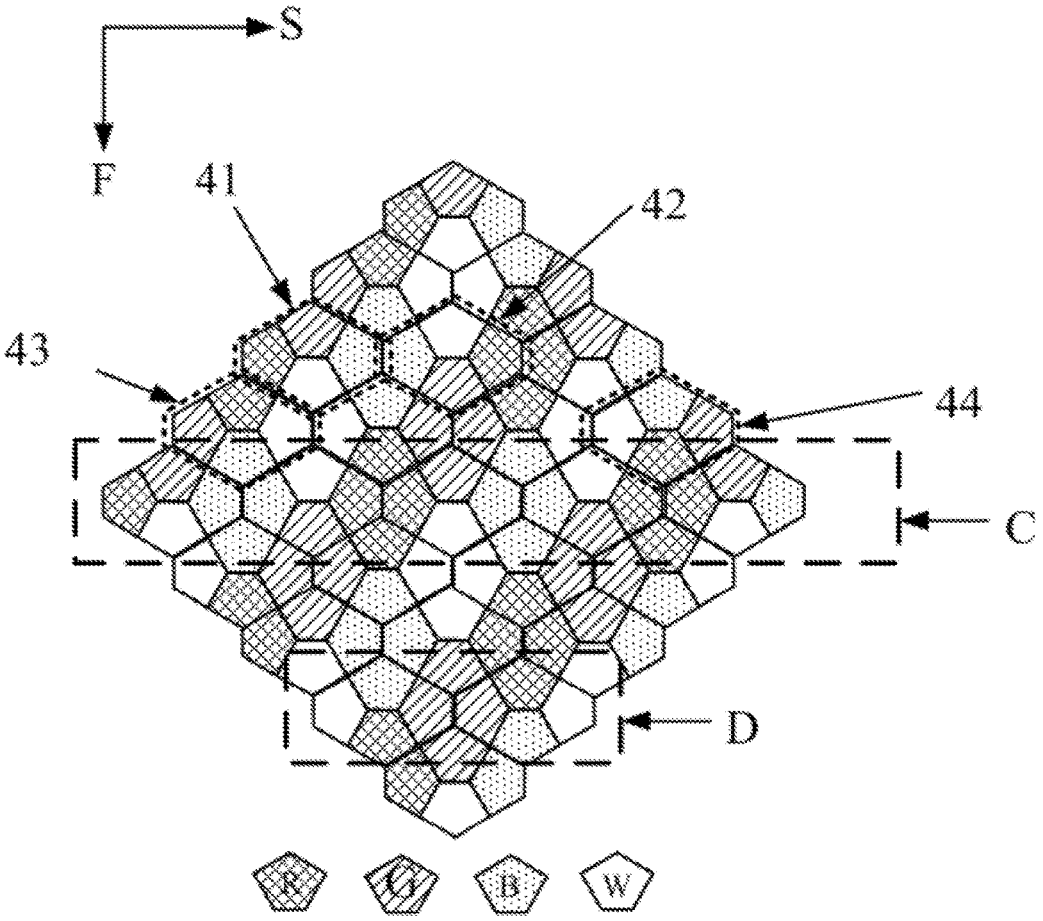
FIG. 10 illustrates a schematic view of an exemplary RGBW pixel arrangement in an exemplary OLED display device according to the disclosed embodiments.

The present disclosure also provides a four-color display device. FIG. 10 illustrates a schematic view of an exemplary RGBW pixel arrangement of in an exemplary OLED display device according to the disclosed embodiments. As shown in FIG. 10, the OLED display device may have a similar pixel unit structure for the pixel arrangement as the previously described three-color display devices. The difference is that in the four-color display device, each pixel unit may include red, green, blue, and white colors. That is, each pixel unit may include red, green, blue, and white sub-pixels.

The similarities between FIG. 10 and FIG. 3 are not repeated here, while certain difference may be explained. As shown in FIG. 10, the first pixel units 41 and the second pixel units 42 may be arranged alternately in a second direction S to form a first pixel row C, and the first pixel unit 41 and the second pixel unit 42 may be centrally symmetric with respect to the center point of the line between the center points of the first pixel unit 41 and the second pixel unit 42. The third pixel units 43 and the fourth pixel units 44 may be arranged alternately in the second direction S to form a second pixel row D, and the third pixel unit 43 and the fourth pixel unit 44 may be centrally symmetric with respect to the center point of the line between the center points of the third pixel unit 43 and the fourth pixel unit 44. The first pixel rows C and the second pixel rows D may be arranged alternately in a first direction F.

The first pixel unit 41 may include four pentagonal shape sub-pixels, which may form a hexagon. In one embodiment, as shown in FIG. 10, the four sub-pixels in the first pixel unit 41 may have red, green, white, and blue colors. Regardless of the sub-pixel color arrangement in the first pixel unit 41, the overall pixel arrangement of the eventually formed OLED display device may have the four colors evenly distributed. Thus, the similarities between the three-color system and the four-color system are not repeated here, while certain differences may be explained.

Although the OLED display device disclosed by the present disclosure have different pixel arrangement as compared to the existing technology, the operating principle of the OLED display device may be similar. For example, given the external signal inputs, the driving circuit may selectively turn on or turn off the thin film transistors (TFT) corresponding to the sub-pixels in the pixel units. Under the control of the driving circuit, the TFTs corresponding to the sub-pixels may send the pre-determined desired voltages to the reflective anodes of the OLED display device. Thus, voltage differences may be formed between the reflective anodes and the semi-transparent cathodes, electrons and holes may be injected into the light-emitting material through the anodes and cathodes, and the light-emitting material may be excited to emit light.

Figure 11:
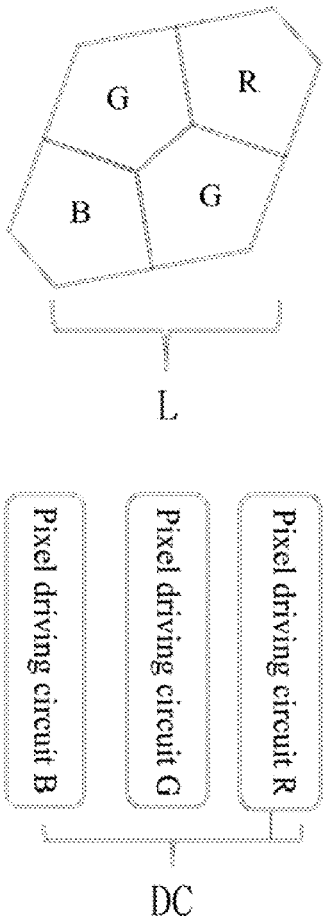
FIG. 11 illustrates an exemplary pixel driving method for an exemplary OLED display device according to the disclosed embodiments.

FIG. 11 illustrates an exemplary pixel driving method for an exemplary OLED display device according to the disclosed embodiments. As shown in FIG. 11, the upper portion of FIG. 11 shows a sub-pixel arrangement L in the light-emitting region of pixels (i.e., the pixel light-emitting region) in the OLED display device, and the lower portion of FIG. 11 shows a pixel driving circuit arrangement DC of the TFT layer corresponding to the sub-pixel arrangement L in the upper portion.

Each of the RGB color sub-pixels may correspond to a pixel driving circuit for the color. That is, each of the RGB color sub-pixels may have a corresponding pixel driving circuit. For example, the blue color sub-pixel B in the sub-pixel arrangement L in the pixel light-emitting region in the upper portion may correspond to the pixel driving circuit for blue color (i.e., the pixel driving circuit B) in the pixel driving circuit arrangement DC of the TFT layer in the lower portion, and the red color sub-pixel R in the sub-pixel arrangement L in the pixel light-emitting region in the upper portion may correspond to the pixel driving circuit for red color (i.e., the pixel driving circuit R) in the pixel driving circuit arrangement DC of the TFT layer in the lower portion.

When a pixel unit includes two same color sub-pixels, both same color sub-pixels may be controlled by a common pixel driving circuit. As shown in FIG. 11, the two green color sub-pixels G in the sub-pixel arrangement L in the pixel light-emitting region in the upper portion may correspond to the pixel driving circuit for green color (i.e., the pixel driving circuit G) in the pixel driving circuit arrangement DC of the TFT layer in the lower portion. The two same color sub-pixels may be connected together by a conductive wire and, meanwhile, may be connected to the anode corresponding to the sub-pixels. Thus, the two sub-pixels may receive the same data signal and may be controlled simultaneously.

The OLED display device disclosed by the present disclosure may reduce the complexity of the mask fabrication without increasing the complexity of pixel driving circuits as compared to the existing technology.

Figure 12:
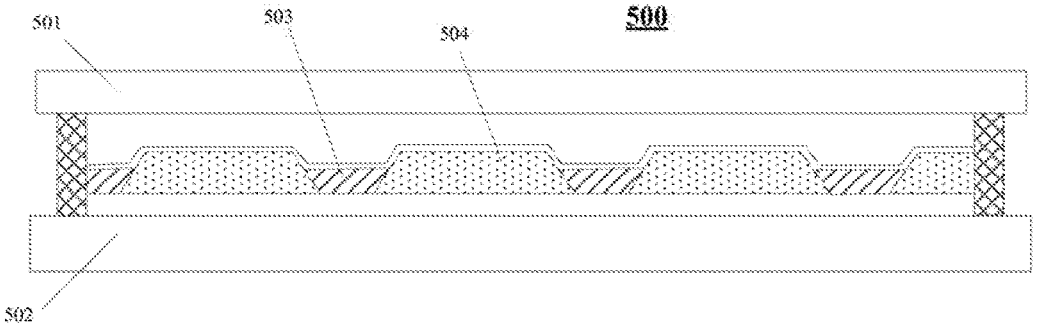
FIG. 12 illustrates a cross-sectional view of an exemplary OLED display device according to the disclosed embodiments.

FIG. 12 illustrates a cross-sectional view of an exemplary OLED display device according to the present disclosure. The OLED display device 500 may mainly include a first substrate 501, a second substrate 502, a pixel defining layer 504, and a plurality of sub-pixels 503 disposed on the second substrate 502. The pixel defining layer 504 may be disposed between the sub-pixels. The pixel defining layer 504 may separate the sub-pixels having different colors. Other appropriate components may also be included.

Figure 13:
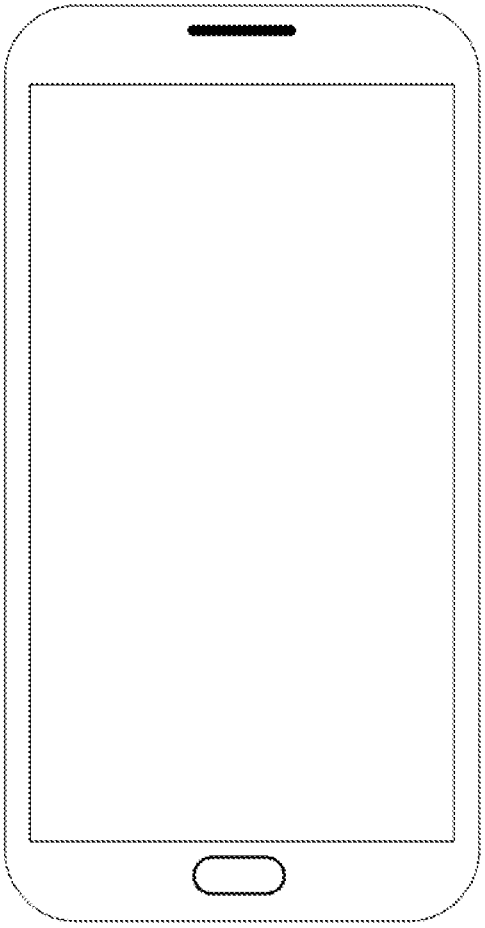
FIG. 13 illustrates an exemplary OLED display device according to the disclosed embodiments.

FIG. 13 illustrates a schematic view of an exemplary OLED display device according to the present disclosure. In one embodiment, the OLED display device 600 may be a smart phone. The OLED display device disclosed by the present disclosure may not be limited to a smart phone, and may be any suitable products having display function, such as a television set, a computer, and a display terminal for industrial control or medical device, which is not limited by the present disclosure.

In the disclosed embodiments, the OLED display device may include the first pixel unit, the second pixel unit, the third pixel unit, and the fourth pixel unit arranged repetitively. Each pixel unit may include four sub-pixels. The four sub-pixels may have the same pentagonal shape and size, and together may form the hexagon. By arranging the four pixel units, the sub-pixels disposed in different pixel units while having the same color may form the hexagon.

Thus, when fabricating the mask, the hexagon formed by the sub-pixels having the same color may be formed as one opening of the mask thereby increasing the size of the mask opening (e.g., slit, slot) and the gap between the openings. Thus, the complexity of the mask fabrication process may be reduced. In the vapor deposition process of the pixel colors, the increased feature size of the mask may reduce the difficulty of mask alignment, and may suppress the color mixing. Because the complexity of the mask fabrication process is reduced and the color mixing is suppressed during the vapor deposition, the display panel resolution may be further improved.

It should be noted that the various embodiments in the present specification are described in a progressive manner. Each embodiment is mainly described in terms of differences from the previously described embodiments. The similarities between different embodiments are not repeated, and may be incorporated by references.

Various embodiments have been described to illustrate the operation principles and exemplary implementations. It should be understood by those skilled in the art that the present disclosure is not limited to the specific embodiments described herein and that various other obvious changes, rearrangements, and substitutions will occur to those skilled in the art without departing from the scope of the disclosure. Thus, while the present disclosure has been described in detail with reference to the above described embodiments, the present disclosure is not limited to the above described embodiments, but may be embodied in other equivalent forms without departing from the scope of the present disclosure, which is determined by the appended claims.

What is claimed is:

1. An organic light-emitting diode (OLED) display device, comprising:

a plurality of first pixel rows and a plurality of second pixel rows alternately arranged in a first direction, wherein a first pixel row includes a plurality of first pixel units and a plurality of second pixel units arranged alternately in a second direction, and a second pixel row includes a plurality of third pixel units and a plurality of fourth pixel units arranged alternately in the second direction, wherein:

a first pixel unit, a second pixel unit, a third pixel unit, and a fourth pixel unit have an identical hexagonal shape, and each includes a first sub-pixel, a second sub-pixel, a third sub-pixel, and a fourth sub-pixel;

the first sub-pixel, the second sub-pixel, the third sub-pixel, and the fourth sub-pixel have an identical pentagonal shape, and each includes at least three colors; and the first sub-pixel in the first pixel unit, the second sub-pixel in the second pixel unit adjacent to the first pixel unit, the third sub-pixel unit in the third pixel unit adjacent to both the first pixel unit and the second pixel unit, and the fourth sub-pixel unit in the fourth pixel unit adjacent to both the first pixel unit and the second pixel unit have a same color and together form a hexagon.

2. The OLED display device according to claim 1, wherein:

the first pixel unit and the second pixel unit are centrally symmetric with respect to a center point of a line between center points of the first pixel unit and the second pixel unit;

the third pixel unit and the fourth pixel unit are centrally symmetric with respect to the center point of a line between the center points of the third pixel unit and the fourth pixel unit;

the center point of the third pixel unit is located on a perpendicular bisector of the line between the center points of the adjacent first pixel unit and the adjacent second pixel unit; and the center point of the fourth pixel unit is located on a perpendicular bisector of the line between the center points of the adjacent first pixel unit and the adjacent second pixel unit.

3. The OLED display device according to claim 2, wherein:

in the pixel unit, the first sub-pixel and the second sub-pixel are centrally symmetric with respect to the center point of the pixel unit; and the third sub-pixel and the fourth sub-pixel are centrally symmetric with respect to the center point of the pixel unit.

4. The OLED display device according to claim 3, wherein:

the sub-pixel in the pentagonal shape has a first inner angle, a second inner angle, a third inner angle, a fourth inner angle, and a fifth inner angle sequentially;

the first inner angle and the third inner angle are right angles;

two sides of the first inner angle have an equal length; and two sides of the third inner angle have an equal length.

5. The OLED display device according to claim 4, wherein:

the fourth inner angle is an obtuse angle.

6. The OLED display device according to claim 5, wherein:

the two sides of the first inner angle and the two sides of the third inner angle have an equal length.

7. The OLED display device according to claim 1, wherein:

each pixel unit includes at least red, green and blue colors.

8. The OLED display device according to claim 7, wherein:

each pixel unit includes red, green and blue colors.

9. The OLED display device according to claim 8, wherein:

the third sub-pixel and the fourth sub-pixel in the first pixel unit have a same color; and the first sub-pixel and the second sub-pixel in the first pixel unit have different colors.

10. The OLED display device according to claim 9, wherein:

the third sub-pixel and the fourth sub-pixel in the first pixel unit have green color, blue color, or red color.

11. The OLED display device according to claim 9, wherein:

the third sub-pixel and the fourth sub-pixel in the first pixel unit are controlled by a common pixel driving circuit.

12. The OLED display device according to claim 11, wherein:

each pixel unit includes two sub-pixels of a same color; and the two sub-pixels of the same color are controlled by a common pixel driving circuit.

13. The OLED display device according to claim 8, wherein:

the first sub-pixel and the third sub-pixel in the first pixel unit have a same color; and the second sub-pixel and the fourth sub-pixel in the first pixel unit have different colors.

14. The OLED display device according to claim 13, wherein:

the first sub-pixel and the third sub-pixel in the first pixel unit have green color, blue color, or red color.

15. The OLED display device according to claim 13, wherein:

the first sub-pixel and the third sub-pixel in the first pixel unit are controlled by a common pixel driving circuit.

16. The OLED display device according to claim 15, wherein:

each pixel unit includes two sub-pixels of a same color; and the two sub-pixels of the same color are controlled by a common pixel driving circuit.

17. The OLED display device according to claim 8, wherein:

the first sub-pixel and the second sub-pixel in the third pixel unit have a same color; and the third sub-pixel and the fourth sub-pixel in the third pixel unit have different colors.

18. The OLED display device according to claim 17, wherein:

the first sub-pixel and the second sub-pixel in the third pixel unit have green color, blue color, or red color.

19. The OLED display device according to claim 18, wherein:

the first sub-pixel and the second sub-pixel in the third pixel unit are controlled by a common pixel driving circuit.

20. The OLED display device according to claim 7, wherein:

each pixel unit includes red, green, blue and white colors.

* * * * *